US006933856B2

(12) United States Patent
Schultz

(10) Patent No.: US 6,933,856 B2
(45) **Date of Patent: *Aug. 23, 2005**

(54) ADAPTIVE ACOUSTIC TRANSMITTER CONTROLLER APPARATUS AND METHOD

(75) Inventor: Roger L. Schultz, Aubrey, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 747 days.

This patent is subject to a terminal disclaimer.

(21) Appl. No.: 09/921,118

(22) Filed: Aug. 2, 2001

(65) Prior Publication Data

US 2003/0026169 A1 Feb. 6, 2003

(51) Int. Cl.[7] ..... G01V 1/00
(52) U.S. Cl. ..... 340/854.3; 367/82; 702/16
(58) Field of Search ..... 340/855.4, 855.6, 340/855.3; 367/82, 83, 75; 455/63.1, 278.1, 73, 11.4; 375/296

(56) References Cited

U.S. PATENT DOCUMENTS

| | | | |
|---|---|---|---|
| 3,252,225 A | 5/1966 | Hixson | |
| 4,314,365 A | 2/1982 | Petersen et al. | |
| 4,390,975 A | 6/1983 | Shawhan | |
| 4,562,559 A | 12/1985 | Sharp et al. | |
| 4,992,997 A | 2/1991 | Bseisu | |
| 5,050,132 A | 9/1991 | Duckworth | |
| 5,124,953 A | 6/1992 | Grosso | |
| 5,128,901 A | 7/1992 | Drumheller | |
| 5,148,408 A | 9/1992 | Matthews | |
| 5,151,882 A | 9/1992 | Kingman | |
| 5,251,328 A | 10/1993 | Shaw | |
| 5,272,723 A | 12/1993 | Kimoto et al. | |
| 5,289,354 A | 2/1994 | Clayer et al. | |
| 5,303,203 A | 4/1994 | Kingman | |
| 5,321,981 A | 6/1994 | Macherson | |
| 5,373,481 A | 12/1994 | Orban et al. | |
| 5,417,295 A | 5/1995 | Rao et al. | |
| 5,473,321 A | 12/1995 | Goodman et al. | |
| 5,479,440 A | 12/1995 | Esfahani | |
| 5,490,121 A | 2/1996 | Gardner et al. | |
| 5,504,121 A | 4/1996 | West | |
| 5,960,397 A | 9/1999 | Rahim | |
| 6,002,985 A | 12/1999 | Stephenson | |
| 6,252,518 B1 | 6/2001 | Laborde | |
| 6,285,859 B1 | 9/2001 | Fernandez Duran et al. | |
| 6,320,820 B1 | 11/2001 | Gardner et al. | |
| 6,434,084 B1 * | 8/2002 | Schultz | 367/81 |

FOREIGN PATENT DOCUMENTS

| | | |
|---|---|---|
| WO | WO 98/37465 | 8/1998 |

* cited by examiner

*Primary Examiner*—Michael Horabik
*Assistant Examiner*—Hung Q Pang
(74) *Attorney, Agent, or Firm*—Peter V. Schroeder

(57) ABSTRACT

The invention describes a method and apparatus for effectively communicating data along the acoustic channel of a subterranean well. The method comprises optimally driving an acoustic transmitter with an adaptive transmitter controller. A data signal is transmitted along the acoustic channel and detected as a distorted signal along the acoustic channel. The distorted signal is input to the adaptive transmitter controller which, based on the detected signal, modifies later transmissions to counteract the distorting effects of the transmitter and acoustic channel. The adaptive transmitter controller preferably comprises a neural network. Another receiver may be employed, at a point further from the transmitter, to receive the optimized signals.

28 Claims, 8 Drawing Sheets

ADAPTIVE ACOUSTIC TRANSMITTER CONTROLLER APPARATUS AND METHOD

TECHNICAL FIELD

The present invention pertains to a system for transmitting acoustic data in an oil well environment. Specifically, the invention pertains to an adaptive acoustic transmitter controller apparatus and method.

BACKGROUND

Interest has increased in transmitting acoustic signals to and from locations in an oil well environment. The basic operating principal in acoustic signal transmission in a tubular media is to impart propagating stress waves into a pipe or tubing string which travel within the pipe to a distant location where transducers detect the signal which is then interpreted by the receiving equipment. In this way, data and signals can be transmitted via mechanical tubular transmission channels such as pipe or tubing.

There are many practical problems associated with using this scheme. When tubing, drill pipe or casing is used as an acoustic transmission channel, there is often significant signal distortion due to reflective interfaces in the channel such as tool joints, collars or other upsets. Additionally, there can be significant attenuation and interference associated with the fluid system within the wellbore and echos of the acoustic signals themselves within the wellbore. Unwanted interfering signals caused by external disturbance sources may also be present in the acoustic channel. These factors significantly reduce the conditions under which acoustic data transmission may be effectively utilized. Acoustic data transmission may be limited by the distance of the transmission, the number and type of upsets in a drill string.

Efforts to effectively transmit data acoustically have often centered on careful control of the frequency and bandwidth of the transmission, the timing of the transmission and the duration of the transmission. U.S. Pat. No. 3,252,225 issued to Hixon and U.S. Pat. No. 4,314,365 issued to Petersen teach selection of transmission wave length based upon pipe characteristics such as the length of pipe sections and the overall length of the drill string. U.S. Pat. No. 4,390,975 issued to Shawhan suggests delaying successive acoustic data transmissions to allow reflections of earlier transmissions to dissipate. Similarly, U.S. Pat. No. 5,050,132 issued to Duckworth discloses transmissions of acoustic data signals only during preselected short time intervals to avoid data distortion. U.S. Pat. No. 5,124,953 issued to Grosso discloses selecting a passband frequency for acoustic data transmission that best correlates a measured and a modeled Apower spectral density of the acoustic transmission. U.S. Pat. No. 5,148,408 issued to Matthews similarly suggests the testing and finding of an optimum frequency for acoustic data transmission which results in the most efficient reception of the acoustic data under the circumstances then present in the well. The Matthews patent suggested period testing of data transmission through the drill string during drilling operations, finding an optimum frequency for transmission based upon drill string conditions at the time of testing, and changing the acoustic data transmission frequency as needed. U.S. Pat. No. 4,562,559 issued to Sharp et al, proposes a phase-shifted transmission wave having a broader frequency spectrum to bridge gaps in the passbands. U.S. Pat. No. 5,128,901 issued to Drumheller proposes transmission of acoustic data conditioned to counteract interference caused by the drill string. Prior to transmission, each signal frequency is multiplied by a factor designed to enhance data transmission.

In many communications systems it is possible to model the communication channel before the system is placed in service, then to design an acoustic transmitter to compensate for the channel distortion. Unfortunately, in an oil well the acoustic transmission environment changes continuously, so it is impossible to design a static acoustic transmitter, which is tailored to the oil well environment. Further complicating acoustic equalization is the complex acoustic environment in an oil well which often contains non-linearities which cannot be effectively modeled using linear filtering techniques.

From the foregoing, it is apparent that a need exists for improved methods of acoustic data transmission and, in particular, a need exists for utilizing such improved methods of acoustic data transmission in oil well environments. Furthermore, it would be desirable to provide such methods, which compensate for changes in the environments in which the acoustic data transmission occurs.

SUMMARY

The invention describes a method and apparatus for effectively communicating data along the acoustic channel of a subterranean well. The method comprises optimally driving an acoustic transmitter with an adaptive transmitter controller. A data signal is transmitted along the acoustic channel and detected as a distorted signal along the acoustic channel. The distorted signal is input to the adaptive transmitter controller which, based on the detected signal, modifies later transmissions to counteract the distorting effects of the transmitter and acoustic channel. The adaptive transmitter controller preferably comprises a neural network. Another receiver may be employed, at a point further from the transmitter, to receive the optimized signals.

DESCRIPTION OF THE DRAWINGS

Drawings of a preferred embodiment of the invention are annexed hereto, so that the invention may be better understood, in which.

Numeral references are employed to designate like parts throughout the various figures of the drawing. Terms such as "left," "right," "clockwise," "counter-clockwise,"

"horizontal," "vertical," "up" and "down" when used in reference to the drawings, generally refer to orientation of the parts in the illustrated embodiment and not necessarily during use. The terms used herein are meant only to refer to relative positions and/or orientations, for convenience, and are not to be understood to be in any manner otherwise limiting. Further, dimensions specified herein are intended to provide examples and should not be considered limiting.

DESCRIPTION OF A PREFERRED EMBODIMENT

Figure 1:
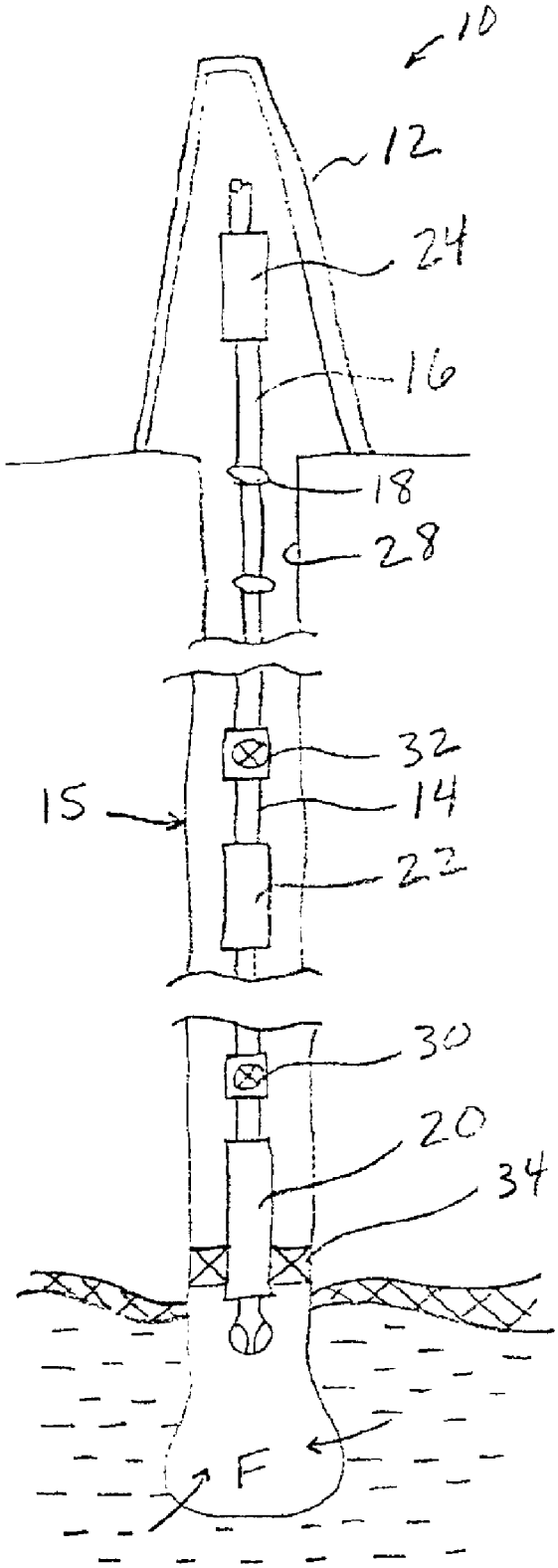
FIG. 1 is a cross-sectional elevational view of a downhole drilling apparatus.

FIG. 1 is a representational view of a typical subterranean drilling apparatus 10. Drilling rig 12 operates to support and drive a drill string 14. The drill string 14, tubing and the well bore comprise an acoustic channel 15. The acoustic channel can include greater or fewer elements, depending on the drilling, testing or production operations underway and can comprise any well parts or tools present at the time. The drill string 14 is often made up of a plurality of pipe sections 16 connected together by tool joints 18. The drill string 14 is used for operations within a wellbore 28 which may bear casing along portions of its length. Depending on the circumstances at the well site, the drill string 14 may include valves 30 and 32, packers 52, subassemblies, collars or other upsets. The apparatus herein may be utilized during well operations of any sort, including drilling, testing, completion and production. FIG. 1 shows communication units 20, 22 and 24 which may be placed on, in or near the drill string 14, below, at or above the surface 26, as shown. The communication units 20, 22 and 24 may be utilized for transmitting and/or receiving acoustic signals to and from locations within an oil well. For example, communication unit 20 may transmit acoustic signals utilizing the adaptive methods described herein, to a receiver at communication unit 24.

Methods and apparatus for transmitting and receiving acoustic signals to and from locations within an oil well and utilizing adaptive equalizers to enhance such communication are described in copending U.S. patent application Ser. No. 09/444,947 by Roger Schultz, which is incorporated herein by reference for all purposes in its entirety.

Figure 2:
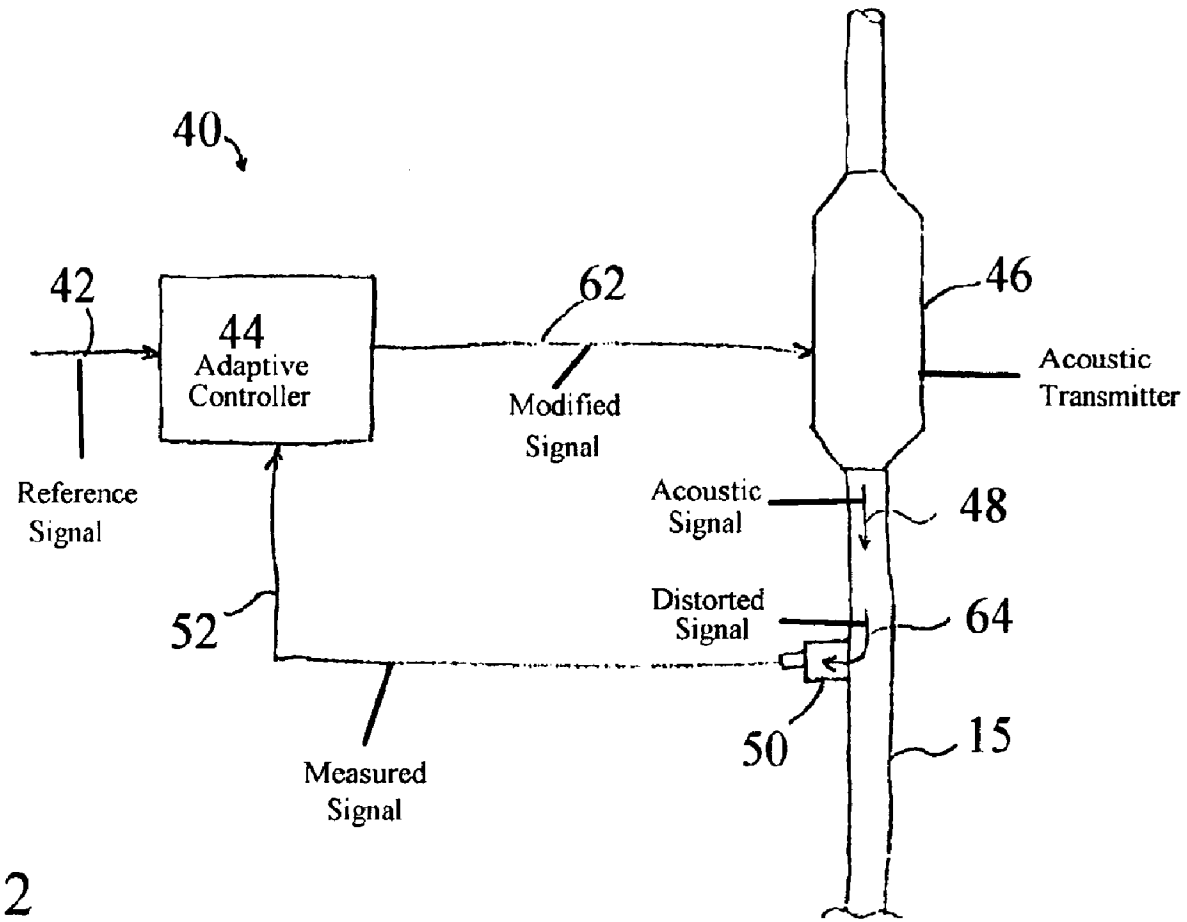
FIG. 2 is a component schematic of the acoustic transmission system.

The communication unit described herein is an adaptive acoustic transmitter 40 and can be used at the surface or downhole. FIG. 2 is a component schematic of the transmitter 40 and acoustic channel 15 system. A reference data signal 42 is provided to an adaptive transmitter controller 44, which drives the acoustic signal generator or transmitter 46. The acoustic transmitter 46 converts the reference data signal 42 into a related acoustic reference signal 48 which is then transmitted into the acoustic channel 15. The acoustic reference signal 48 is distorted by the response characteristics of the transmitter 46 and acoustic channel 15. Additionally, the acoustic reference signal 48 is distorted by noises imparted into the acoustic channel 15 from external acoustic noise sources that may be present within the well 28 or at the surface 26. The distorted acoustic reference signal 48 is detected a distance from the transmitter 46 by an acoustic receiver 50. The acoustic receiver 50 converts the distorted acoustic signal into a corresponding measured reference data signal 52 that is input into the adaptive controller 44.

The adaptive controller 44 serves two functions. The adaptive controller 44 optimally drives the acoustic transmitter 46 by providing modified data signals 62 for transmission into the acoustic channel 15, where the modified signals 62 are selected to counteract the distorting effects of the transmitter 46 and acoustic channel 15. That is, the modified signal is selected such that, once transmitted into the acoustic channel, distorted by the transmitter and channel characteristics, and then received by the receiver, the now distorted modified reference signal 62 closely resembles or matches the desired reference signal 42 upon detection at some distance downhole. The modified signals 62 are related to the desired reference signal 42 by a mathematical function which is produced by the transmitter controller 44, using an adaptive system utilizing an interactive process. The adaptive controller also functions to predict disturbance noises imparted into the acoustic channel by external acoustic noise sources and to provide modified signals for transmission into the acoustic channel which are selected to minimize or remove the distorting effects of these ambient noises on the transmitted signal by destructive interference.

In one embodiment of the invention, by optimally driving the acoustic transmitter 46 to emit modified acoustic signals which counteract the effects of the acoustic system over the relatively short distance between the transmitter 46 and acoustic receiver 50, and to predict and counteract external disturbances, the transmitter 46 located in one communication unit 20 is able to emit modified signals to be received and interpreted by a communication unit 24 a greater distance away. The signals received at the farther communication unit 24 will be distorted during travel along the greater distance, but the modification of the signal prior to transmission will limit or reduce these effects, making the signal received by the farther unit 24 readable.

Figure 3:
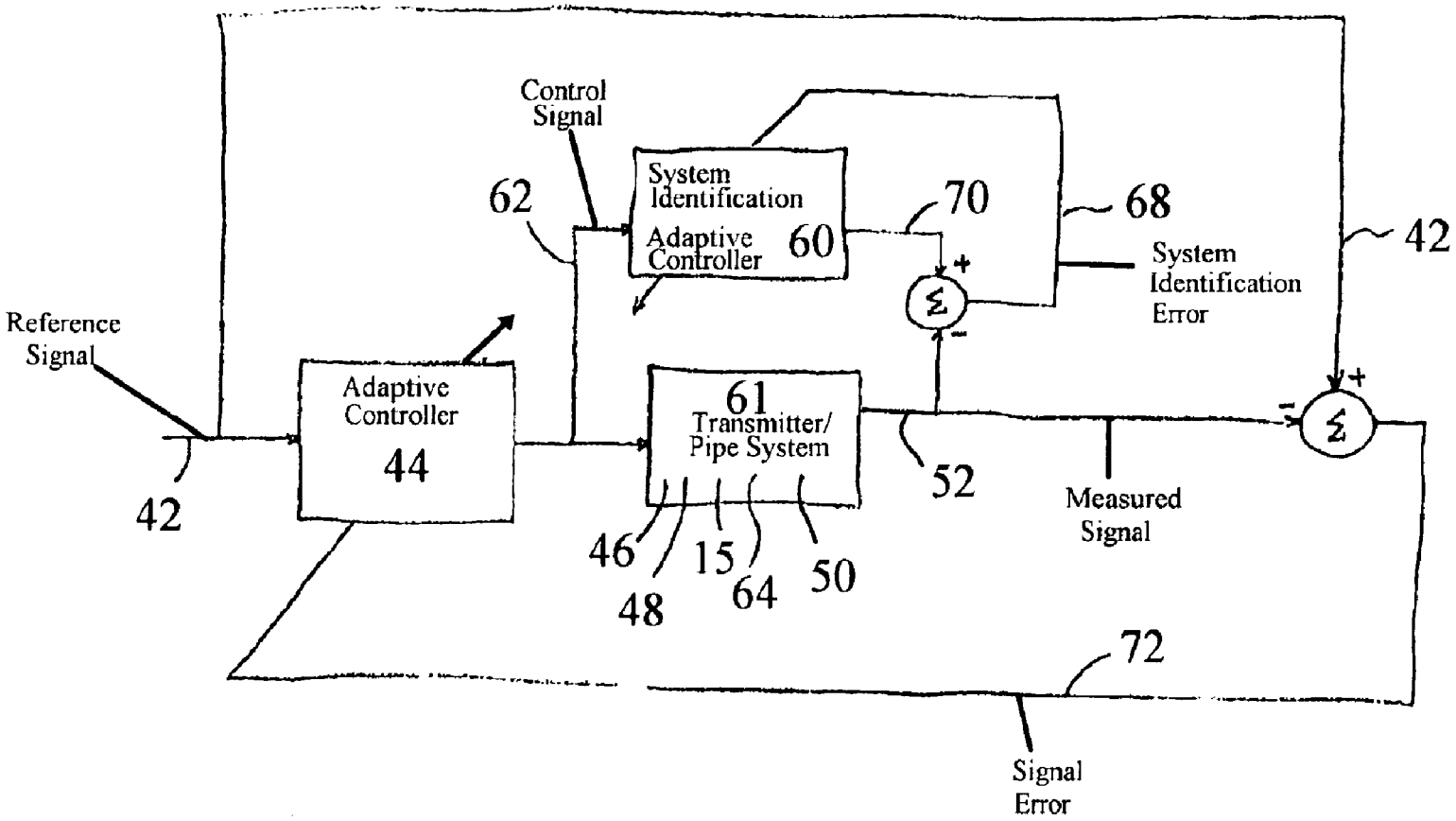
FIG. 3 is a detailed component schematic of the acoustic transmission system.

FIG. 3 shows a detailed schematic of the system. A selected data signal 42 is input to the adaptive transmitter controller 44. The adaptive controller 44 can manipulate the reference data signal 42 prior to sending a controller data signal 62 to the acoustic transmitter 46. The acoustic transmitter 46 can be of the kind known in the art and can include an activator, such as a stack, a vibrator, or an oscillator for creation of the acoustic signal. The controller data signal 62 is also input to the system identification adaptive controller 60, as will be explained herein.

The acoustic transmitter 46, the pipe system 15, and receiver 46 are represented by the transmitter and pipe system 61. The acoustic signals 48 and distorted signals 64 are similarly blocked into the transmitter and pipe system 61. The acoustic transmitter 46 emits an acoustic signal 48 into the acoustic channel 15, where it is distorted by the response characteristics of the transmitter 46 itself and of the acoustic channel 15 and by external interferences. The distorted acoustic signal 64 is detected by an acoustic receiver 50 at some distance from the acoustic transmitter 46. The receiver 50 produces a measured data signal 52, corresponding to the distorted and received acoustic signal 64. The measured data signal 52 is compared to, that is, subtracted from, the reference signal 42, yielding a pipe signal error 72, which is input to the transmitter controller 44. It is understood that the comparative process may physically occur in the same location or as part of the function of the transmitter controller.

The desired data signal 42 and the measured data signal 52 from the acoustic receiver 50 are compared to produce a pipe signal error 72. The transmitter controller 44, based on the pipe signal error 72 calculation, then modifies subsequent transmissions of controller data signals 62, to reduce or eliminate subsequent pipe signal errors 72. The transmitter controller 44 is "trained" to produce controller data signals that will provide at least minimally acceptable pipe signal errors 72. To properly train the controller 44, however, the pipe signal error 72 must be back—propagated through the system identification model 60 and into the transmitter controller 44 so the training of the transmitter controller 44 may progress.

The system identification model 60 is used to adaptively develop a mathematical model of the acoustic transmitter 46 and acoustic channel 15. The control signal 62 is input to the system identification model 60. The system identification model 60 emits a system identification output 70. By comparing, or finding the difference between, the measured data signal 52 and the system identification output 70, a system identification error 68 can be computed. The system identification error 68 can be used to "train" the adaptive system identification model 60. The system identification error 68 is utilized by the system identification model 60 to modify subsequently transmitted system identification outputs 70 to minimize or eliminate the system identification error 68. The subsequent system identification outputs 70 are related to previous system identification outputs by a mathematical formula. The system identification model 60 produces a mathematical function designed to eliminate or reduce the system identification error 68 utilizing an interactive mathematical process. The system identification model 60 affectively provides a mathematical model of the transmitter and pipe system 61 for use in back-propagation.

The source of the initial reference data signal depends on the purpose of the acoustic data transmission. For example, a downhole communication unit, such as communication unit 20 or 22 in FIG. 1, may include one or more transducers or other sensors for measuring downhole well conditions such as pressure, temperature, well fluid rate, salinity, pH density or weight. The data measuring devices may be transducers, accelerometers or other sensors and may include power sources, electrical circuits, memory storage units, computers or other components as necessary. Further, the data may be input from a location remote to the communication unit depending on the particular circumstances at the well. That is, the pressure and temperature transducers, for example, may be placed in a sub for exposure to the well environment and transmit measured data to the communication unit.

A downhole unit 20 may also monitor aspects of well equipment, either directly or indirectly. For example, appropriate instrumentation may directly monitor whether a valve, such as valve 30 or 32, is open or closed by measuring the position of the valve actuator or other valve element. Alternatively, acquisition of data on fluid flow or pressure at or near the valve may indirectly indicate the position of the valve. Similarly, acquired data may be used to indicate the operational status of downhole tools, collars, packers, tool joints, the drill string or any other well equipment.

Data may also be an input from an operator or other source at a surface communication unit such as communication unit 24. The surface communication unit 24 may receive input data that will be used to interrogate a downhole sensor or operate one or more downhole tools. The data input may come from a computer, sensor, other surface equipment or from a well field operator. For example, a computer or other mechanism containing a timer may submit a sequence of predetermined data for transmission downhole at various times, such as periodic requests for updates on downhole conditions or instructions to activate or deactivate various downhole tools or subs. Similarly, rig personnel may input a request for downhole environmental conditions at various times. It is understood that a data acquisition unit in a surface communication unit may also acquire measured data of well conditions, equipment status and the like. The method of data acquisition, input, and the substance of the data does not affect the use of the present invention.

The data signals may be processed by the controllers into a digitized or otherwise readable data signals. Appropriate electrical circuitry, computer, or other processing unit may be utilized to convert the electric or other form of raw data acquired from sensors, testing equipment or input source into a data signal 42 to be transmitted via the acoustic channel 15. The reference and controller data signals may take any form that may then be converted into an acoustic or stress wave transmission. The data signals may send any type of message, whether an interrogatory to a distant transmitter-receiver, information as to test data results, or commands to activate a well tool.

The data signal 42 is transmitted as an acoustic wave signal 48 into the acoustic channel 15, by the acoustic transmitter 46. The transmitter 46 converts the electrical, digitized or otherwise encoded data signal 62 into the acoustic transmission 48 to be propagated to a distant location in the drill string or on the surface.

The transmitter 46 may transmit data as a sinusoidal stress, strain or displacement wave. The acoustic data signal, for example, could be propagated in binary code with a sinusoidal tone burst at a preselected frequency, such as 500 Hz, for a preselected duration, such as one second, representing a binary "1". Similarly, a binary "0" may be transmitted as a sinusoidal tone burst at a distinct frequency, such as 1000 Hz, for a duration of one second. The transmission of data in binary form is well understood. It is understood that the Herz ranges and burst durations are illustrative only and not critical to the practice of the invention. Frequencies and durations may be selected based on the circumstances of the well environment to provide the most easily detectable signals. Additionally, other methods of encoding data in stress waves may be employed, for instance, transmitting data based on a linear scale of frequency modulation or amplitude modulation. The encoding may take any form adequate to convey the information contained in the transmission, and the stress waves may be transmitted as axial, torsional or other types of waves. The mechanics of transmitting stress waves is well known in the art and the selected method is not critical. The waves may be produced by a piezoelectric stack, a vibrator, an oscillator or any other suitable means.

The controller data signal 62 is propagated into the acoustic channel 15 as a clean or clear signal. That is, the signal is not yet corrupted by attenuation in the drill string, interference from reflections, and masking by stress wave noise produced by other acoustic sources. The transmission finally detected by the acoustic receiver 50, therefore, is a distorted acoustic signal 64. The distorted acoustic signal 64 contains the data of the original transmission, but the data may initially be unrecognizable due to these distortions. The adaptive transmitter system 40 corrects this problem. By an iterative method, a mathematical modification to later-sent signals is selected to reduce or eliminate signal errors and thereby produce a received signal 64 resembling the desired reference data signal 42. After such modification has occurred, a modified signal can be effectively transmitted and interpreted over greater distances, for example, from the well surface 26 to a downhole unit, such as unit 20.

The acoustic channel 15 is the physical relay path along which the stress wave signal travels. The channel may be a drill string, casing, well string or any other suitable acoustic medium or a combination thereof. The drill string typically consists of numerous pipe sections 16 strung together by joints 18. The channel may also include collars, valves, subs, packers and various other well equipment. Each of these "upsets" cause reflections and attenuation of an acoustic signal transmitted into the channel. Additionally, the channel may be simultaneously transmitting unrelated acoustic waves, or noise, created by swivel joints, downhole or surface motors, compressors and the like, or by collisions between chains and the Kelley bushing and other equipment.

The acoustic receiver 50 detects the distorted acoustic signal 64 at a point distant from the acoustic transmitter 46. For example, the receiver 50 may be placed a short distance downhole from the transmitter 46. The distance between the transmitter and receiver of the system may vary according to circumstances. The distance is selected to produce an acceptable adaptive modification of the data signals to be later transmitted over even greater distances. That is, the adaptive transmitter controller system 40 is used to determine what modifications are made to data signals prior to transmission into the acoustic channel. These modifications will eliminate or reduce the distorting effects of the channel to allow transmission of readable signals over greater distances, such as from the well surface to a downhole subassembly unit.

In some instances it may be possible to place the receiver 50 at the target location downhole, such as at unit 20, via wireline or other communinication method. This would allow modeling of the entire pipe system and consequent adaptive control of the transmitter, at unit 24, to produce acoustic signals which are modified for attenuation and other disturbances occurring over the entire distance between the transmitter 24 and the target unit 20. Later removal of the receiver 50 from the downhole target location 24 might be required, or desired, such as for commencement of production procedures. The receiver could be periodically run downhole to update the "training" of the transmitter controller system.

The acoustic receiver 50 detects the information contained in the distorted acoustic signal 64 as a distorted data signal 52. The distorted data signal 52 is a digitized or otherwise usable "translation" of the distorted acoustic signal 64. The conversion of the signal may include the use of electric circuitry, memory storage devices, computers, recorders and the like. The distorted data signal, being a translation of the distorted acoustic transmission, will carry the attenuated, distorted data as detected by the receiver.

The distorted data signal includes the encoded information of the original data signal. Problems arise in reading or interpreting that data at a distant location, however, because the distorting effects of the acoustic channel may make the original data unreadable or unrecognizable. In the past, these distorting effects have limited the distances over which information could be relayed, dictated the time frame during which relays could occur and reduced the complexity of the data that could be transmitted. Alternatively, the distorting effects forced extended signal duration to overcome attenuation effects. Where acoustic transmission was difficult or impossible, a physical link, such as a wire line, had to be established between the transmitting and receiving communications units, with inherent difficulties and limitations.

The distorted data signal 52 is used to compute the pipe signal error 72 and the system identification error 68 which are input into the controller 44 and model 60, respectively. The preferred type of adaptive controller is a neural net, however, other types of adaptive controllers may be employed, such as fuzzy filters or frequency domain filters, as are known in the art. Additionally, the adaptive controller model may be linear, nonlinear, recurrent or non-recurrent. The preferred controller model, as explained herein, is a nonlinear, recurrent neural network. The neural network may be a multi-layer perceptron network, that is, a network in which the sums of individually weighted inputs are output to at least one activation function, for example, log-sigmoid, symmetric saturating linear, hard limit, etc., within each layer. It is understood that other types of neural networks may be utilized. System identification model 60 may include similar adaptive and mathematical models and preferably utilizes a neural network.

The use of adaptive controllers is critical in the successful transmission of acoustic signals in a distorting acoustic channel such as present in most oil wells. The adaptive controller system is capable of filtering out "noise" and distortions and isolating the acoustically transmitted data or signals even where the "noise" is variable. That is, whereas a non-adaptive controller system may isolate a signal where the background noise and distortions are in steady state, an adaptive controller system may isolate a signal where the noise distortions are in flux. The adaptive controller system constantly adjusts to optimally equalize a distorted acoustic signal.

Methods of network training are described in copending U.S. patent application Ser. No. 09/298,691 by Roger Schultz, which is incorporated herein by reference in its entirety.

The adaptive controller 44 and the system model 60 may be linear or non-linear, recurrent or non-recurrent, and may be a fuzzy filter, a frequency domain filter, or a neural network filter. Preferably, the adaptive controller and model are neural networks. Network training can be accomplished using an approximate steepest descent method. At each time-step the measured error is used to calculate a local gradient estimation that is used to update the network weights. Recurrent and non-recurrent networks must be trained using separate methods for calculating the cost function gradient, which is used in the approximate steepest descent method of training. For networks that are non-recurrent (i.e. having no feedback), standard back propagation may be used to calculate the necessary gradient terms used in training.

Figure 4:
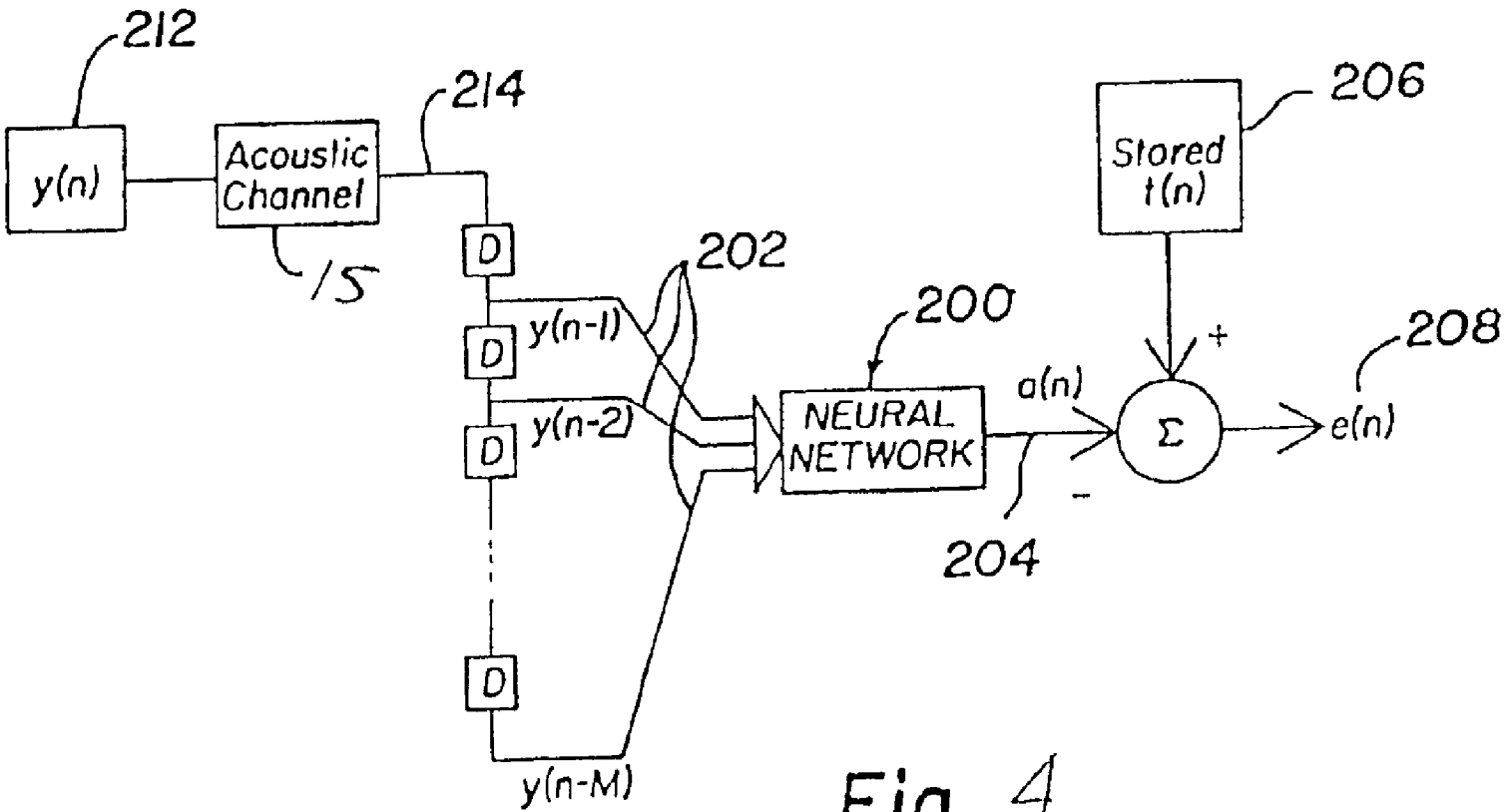
FIG. 4 is a schematic flow chart of a non-recurrent real-time neural network.

FIG. 4 shows a basic non-recurrent real-time network 200 in flow chart form. The chart also shows the system inputs 202, outputs 204, and the pre-selected stored training signal 206 which are used in training the network. The received original training signal 212 is represented as y(n). The system inputs 202 are a plurality of received training signals, designated by a series of signal indications (y(n−1), y(n−2), . . . , y(n−M)) separated by time delays (D). The time delays may or may not be equal. The actual equalizer output 204 is designed by a(n). The error e(n) 208 in FIG. 4 is the difference between the desired network output, the stored training signal 206, designated by t(n), which is identical to the original training signal 212, and the actual network output 204. In a predictive signal processing system the prediction error is calculated as the difference between the measured signal sample, and it=s previously computed prediction. These computed errors are used to adjust the neural network weights to minimize the signal prediction error 208.

Figure 5:
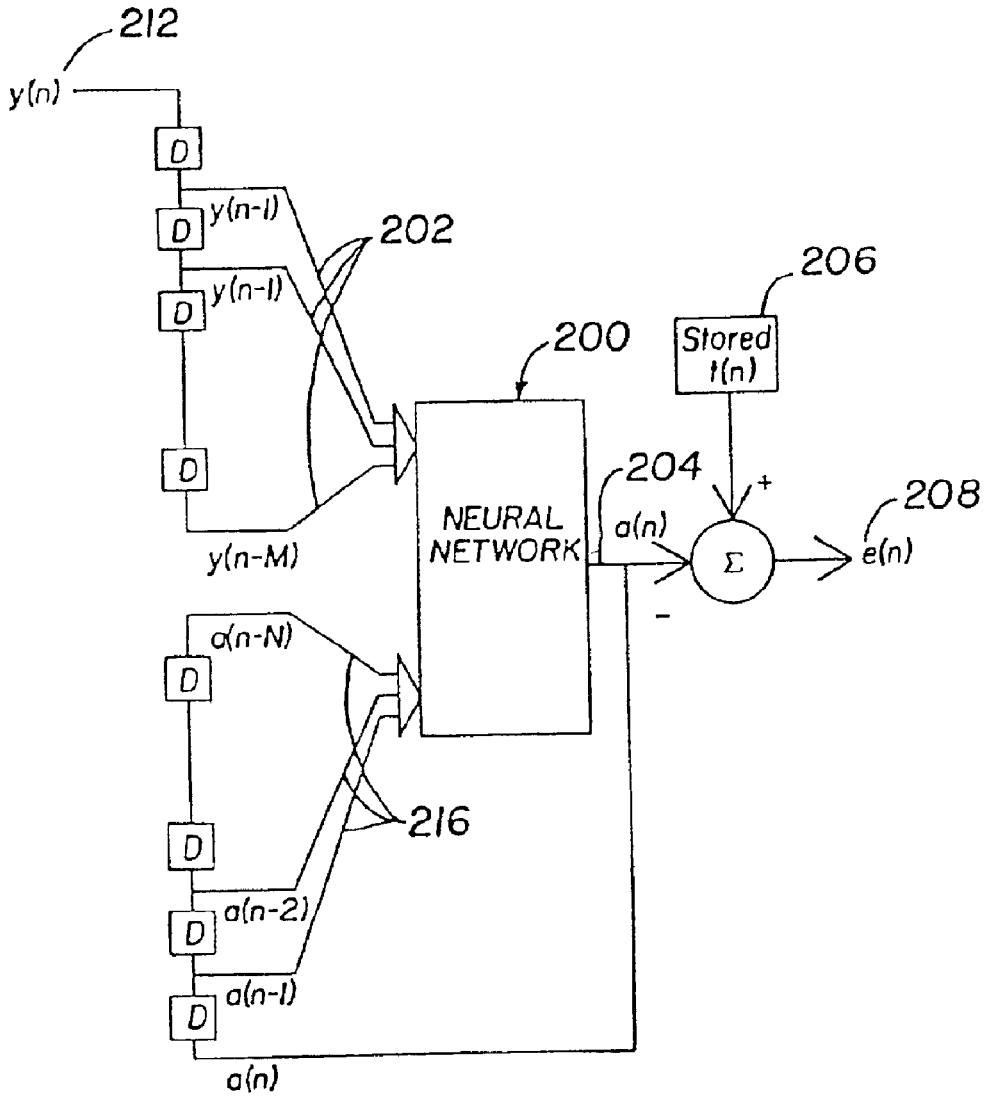
FIG. 5 is a schematic flow chart of a recurrent real-time neural network.

For recurrent networks in which delayed values of the output are fed back as input to the network, a different method of calculating the derivative of the network output with respect to the weights must be used. This is necessary because when a feedback path is present the current output is always a function of the past output. FIG. 5 shows a basic recurrent network with the actual network output a(n) 204 fed back into the neural network as a series of feedback inputs 216, represented by series of signal indications (a(n), a(n−1), a(n−2), . . . , a(n−N)). A method of dynamic back propagation may be used to calculate the gradient for use in weight adjustment. Specifically, the forward perturbation method may be employed to calculate derivatives.

Figure 6:
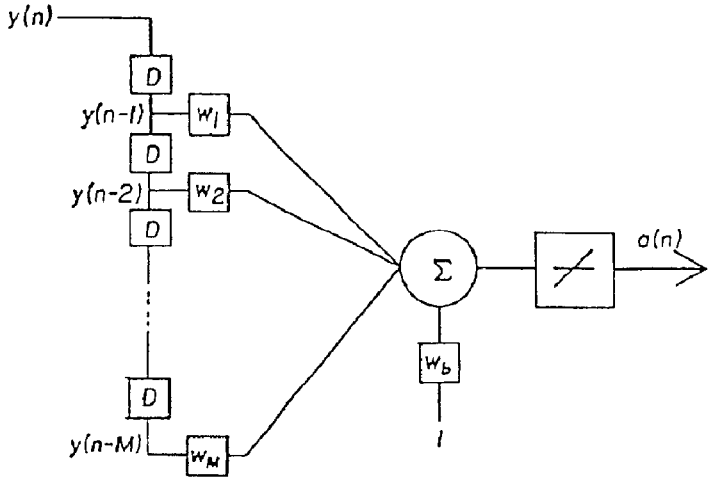
FIG. 6 is a schematic flow chart of a linear non-recurrent neural network.
Figure 7:
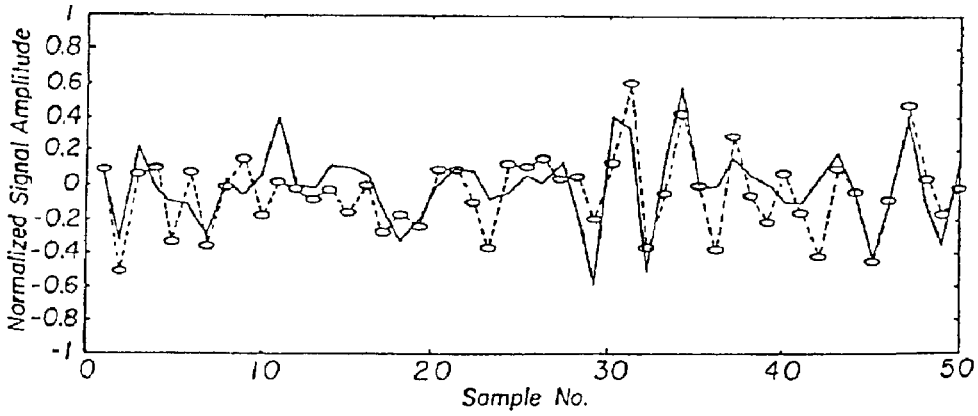
FIG. 7 is a data prediction chart for an experiment utilizing a linear non-recurrent neural network.

Several different network structures will be considered. The more complicated network structures, which are nonlinear or recurrent, or both will provide improved performance in many instances over the simple linear non-recurrent network of FIG. 4. In order to illustrate the enhanced capabilities of the more complicated networks, four different network structures have been used to predict, one step in advance, some experimental data. As a base line, the first network that will be considered has a simple linear non-recurrent structure. The network and test results are shown in FIGS. 5 and 7. As FIG. 6 shows, this network is a single layer network containing no feedback, which utilizes a linear activation function. The prediction of experimental data, as shown in FIG. 7, yielded base-line prediction accuracy as measured by a squared prediction error, of 2.07.

The first type of nonlinear network that was evaluated has a non-recurrent two-layer structure, which contains nonlinear log-sigmoid functions of the form:

$$f(n)=1/(1+e^{-n})$$

Figure 8:
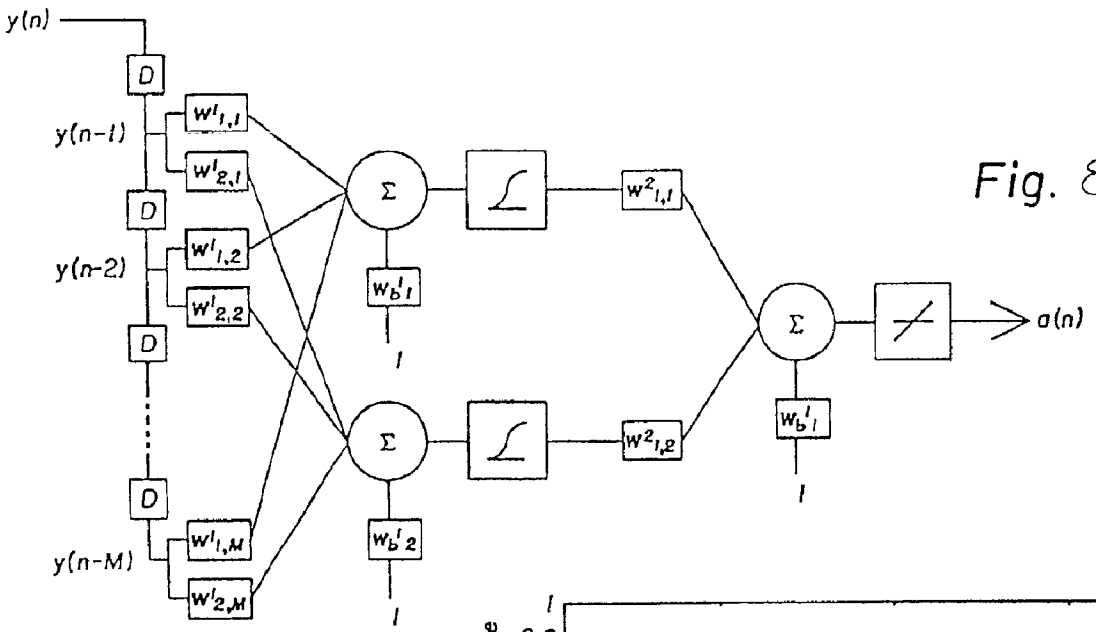
FIG. 8 is a schematic flow chart of a non-linear non-recurrent, neural network.
Figure 9:
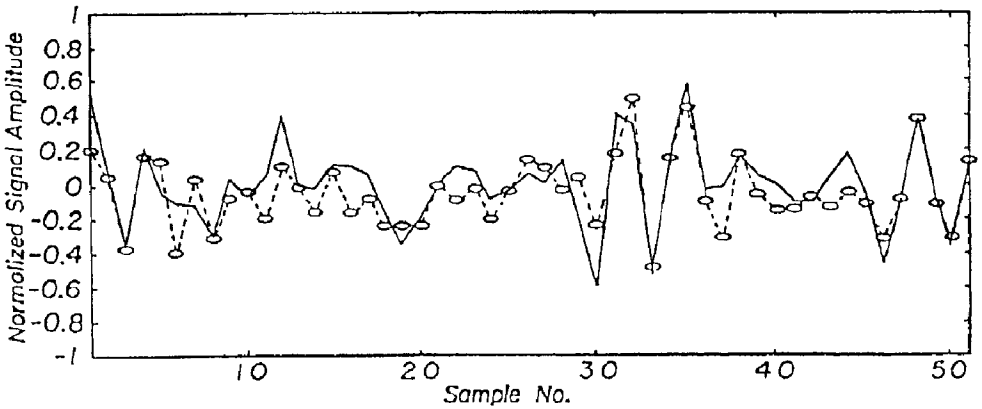
FIG. 9 is a data prediction chart for an experiment utilizing nonlinear non-recurrent, neural network.

FIGS. 8 and 9 show the network and the prediction results. A fairly dramatic improvement in prediction accuracy can be seen with this network. As FIG. 9 shows, the squared predicted error dropped to 1.23 for the non-linear non-recurrent two-layer network indicated in FIG. 8.

Figure 10:
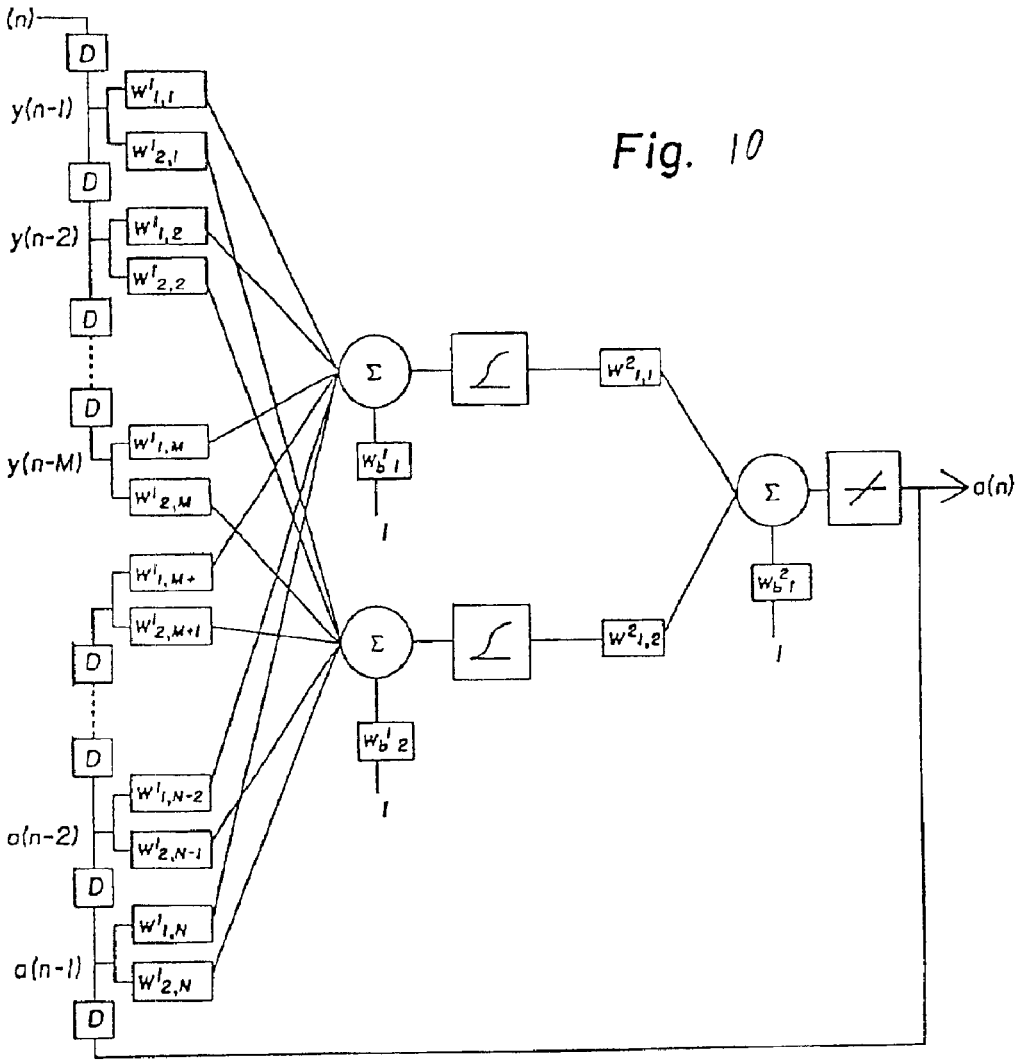
FIG. 10 is a schematic flow chart of a non-linear recurrent neural network.
Figure 11:
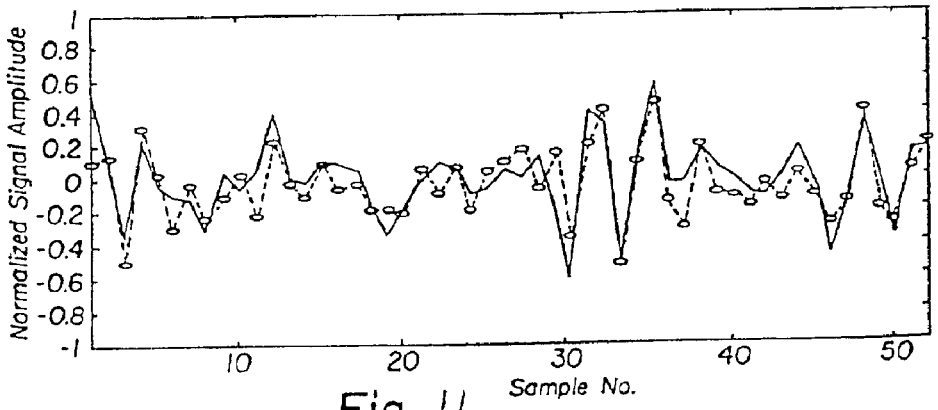
FIG. 11 is a data prediction chart for an experiment utilizing a non-linear recurrent neural network.

FIGS. 10 and 11 show a fully recurrent nonlinear network and the prediction results. The nonlinear recurrent network shown in FIG. 10 is similar to the network of FIG. 8 with one key difference. A feedback loop is present which fills a tapped delay line with past network outputs, which are used as input to the network. This network is most complicated to implement, but provides the best prediction performance. As seen in FIG. 11, the squared prediction error dropped to 1.15 for the experiment employing the non-linear recurrent network of FIG. 10. All networks utilized a 70-tap delay line for inputs, and the recurrent networks used a 10-tap delay for the recurrent inputs. The results shown in FIGS. 7, 9 and 11 indicate that using nonlinear prediction techniques provides better performance than conventional linear prediction techniques.

After careful consideration of the specific and exemplary embodiments of the present invention described herein, a person skilled in the art will appreciate that certain modifications, substitutions, and other changes may be made without substantially deviating from the principles of the present invention. The detailed description is to be understood as being illustrative, the spirit and scope of the present invention being limited solely by the appended claims.

What is claimed is:

1. A method of data transmission in an oil well environment, the method comprising the steps of:

providing a reference data signal to an adaptive transmitter controller having an acoustic transmitter;

transmitting an acoustic reference signal, corresponding to the reference data signal, from an acoustic transmitter at first location along an acoustic channel;

detecting the acoustic reference signal at a second location along the acoustic channel, the acoustic reference signal distorted from the acoustic effects of the transmitter and the acoustic channel;

generating a measured reference data signal in response to the detected acoustic reference signal;

inputting the measured reference data signal to the adaptive transmitter controller; and utilizing the adaptive transmitter controller to optimally drive the acoustic transmitter by providing modified reference data signals for transmission, the modified reference data signals related to the reference data signal by a mathematical function and selected to counteract the distorting acoustic effects of the transmitter and acoustic channel.

2. A method as in claim 1, further comprising the step of providing a reference control signal, related to the reference data signal, from the transmitter controller to an acoustic transmitter.

3. A method as in claim 1, wherein the adaptive transmitter controller comprises a frequency domain filter.

4. A method as in claim 1, wherein the adaptive transmitter controller comprises a neural network.

5. A method as in claim 4, wherein the neural network is a nonlinear recurrent neural network.

6. A method as in claim 1, wherein the acoustic transmitter is positioned downhole.

7. A method as in claim 1, the adaptive transmitter controller further comprising a system identification model.

8. A method as in claim 7, wherein the system identification model comprises a neural network.

9. A method as in claim 1, wherein the first location along the acoustic channel is downhole from the second location along the acoustic channel.

10. A method as in claim 1, wherein the transmitter controller is remotely located from the acoustic transmitter.

11. A method as in claim 1, wherein the reference data signal is a pre-selected training signal for training the adaptive transmitter controller.

12. A method as in claim 1, further comprising the step of positioning a communication unit at a third location along the acoustic channel for detection of transmitted signals.

13. A method as in claim 1, further comprising training the adaptive transmitter controller.

14. A method as in claim 13, wherein the step of training includes temporarily placing an acoustic receiver on a wireline at the second location.

15. A method of transmitting data in an oil well environment comprising the steps of:

transmitting data signals from a transmitter into an acoustic channel;

detecting the corresponding transmitted data signals and inputting the transmitted data signals into an adaptive transmitter controller; and utilizing the adaptive transmitter controller to optimally drive the transmitter by adaptively modifying later-transmitted data signals to counteract the distorting effects of the transmitter and acoustic channel on the transmitted signals.

16. A method as in claim 15, further comprising the step of receiving the later sent signals at a remote location along the acoustic channel.

17. A method as in claim 15, wherein the adaptive transmitter control comprises a neural network.

18. A method as in claim 15, wherein the adaptive transmitter controller comprises a system identification model.

19. A method as in claim 16, wherein the step of detecting comprises placing an acoustic receiver along the acoustic channel at a testing location, the testing location closer to the transmitter than the remote location.

20. A method of transmitting data in an oil well environment comprising the steps of:

providing a reference data signal to an adaptive transmitter controller having an acoustic transmitter;

transmitting an acoustic reference signal, corresponding to the reference data signal, from an acoustic transmitter at first location along an acoustic channel;

detecting the acoustic reference signal at a second location along the acoustic channel, the acoustic reference signal distorted from the acoustic effects of the transmitter and the acoustic channel;

generating a measured reference data signal in response to the detected acoustic reference signal;

inputting the measured reference data signal to the adaptive transmitter controller; and utilizing the adaptive transmitter controller to find a reference signal error and to optimally drive the acoustic transmitter by providing modified data signals for transmission along the acoustic channel, the modified data signals having corresponding modified signal errors upon detection at the second location along the acoustic channel, the modified data signals selected to minimize the corresponding modified signal errors.

21. A method as in claim 20, further comprising the step of mathematically modeling the acoustic transmitter and acoustic channel.

22. A method as in claim 20, further comprising the step of transmitting the modified data signals to an acoustic receiver at a third location along the acoustic channel.

23. A method as in claim 20, wherein the adaptive transmitter controller comprises a neural network.

24. An apparatus for transmitting data along an acoustic channel in an oil well environment, the apparatus comprising:

an adaptive transmitter controller for optimally driving an acoustic transmitter; and an acoustic transmitter operatively connected to the controller and operatively connected to the acoustic channel at a first location to transmit along the channel; and an acoustic receiver placed along the acoustic channel at a second location, the receiver operably connected to the adaptive transmitter controller.

25. An apparatus as in claim 24, further comprising another acoustic receiver placed along the acoustic channel at a remote location.

26. An apparatus as in claim 24, the adaptive transmitter controller having a neural network.

27. An apparatus as in claim 24, the adaptive transmitter controller for mathematically modeling the acoustic effects of the transmitter and the acoustic channel.

28. An apparatus as in claim 24, the acoustic receiver connected to the adaptive transmitter controller by a wireline.

* * * * *